US011429047B2

(12) United States Patent
Nomura et al.

(10) Patent No.: US 11,429,047 B2
(45) Date of Patent: Aug. 30, 2022

(54) ROLLER USED IN FIXING DEVICE, FIXING DEVICE INCLUDING THIS ROLLER, AND IMAGE FORMING APPARATUS

(71) Applicant: CANON KABUSHIKI KAISHA, Tokyo (JP)

(72) Inventors: Takashi Nomura, Shizuoka (JP); Kazuya Nakai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/494,652

(22) Filed: Oct. 5, 2021

(65) Prior Publication Data

US 2022/0113661 A1 Apr. 14, 2022

(30) Foreign Application Priority Data

Oct. 12, 2020 (JP) ..... JP2020-172177

(51) Int. Cl.
*G03G 15/20* (2006.01)

(52) U.S. Cl.
CPC ..... *G03G 15/206* (2013.01); *G03G 15/2053* (2013.01); *G03G 15/2057* (2013.01)

(58) Field of Classification Search
CPC ..... G03G 15/2053; G03G 15/2057; G03G 15/206
See application file for complete search history.

(56) References Cited

U.S. PATENT DOCUMENTS

2014/0205334 A1* 7/2014 Kondoh ..... G03G 15/2053 399/329

FOREIGN PATENT DOCUMENTS

| | | | | |
|---|---|---|---|---|
| JP | 2005292549 A | | 10/2005 | |
| JP | 2014142406 A | | 8/2014 | |
| JP | 5610894 B2 | * | 10/2014 | ..... G03G 15/2057 |
| JP | 2016024214 A | | 2/2016 | |
| JP | 2020034154 A | | 3/2020 | |

* cited by examiner

*Primary Examiner* — Joseph S Wong
(74) *Attorney, Agent, or Firm* — Canon U.S.A., Inc. IP Division

(57) ABSTRACT

A roller used in a fixing device includes a rubber layer including a plurality of void portions, pore passage portions connecting the void portions, and a filler, wherein an aspect ratio RA of the filler is 2.5≤RA≤215, and a linear expansion coefficient of the rubber layer is less than or equal to $400\times10^{-6}$/K.

10 Claims, 9 Drawing Sheets

NORMAL PORTION

DISTORTED PORTION

FIG.8

| | OUTER DIAMETER (mm) OF PRESSURE ROLLER | THICKNESS (mm) OF RUBBER LAYER | TYPE OF FILLER | DIAMETER × LENGTH (μm) OF FILLER | ASPECT RATIO RA OF FILLER | AMOUNT OF ADDITION (vol%) OF FILLER | BALLOON SIZE (μm) | AMOUNT OF ADDITION (vol%) OF BALLOONS | COMMUNICATION RATE (%) OF BALLOONS |
|---|---|---|---|---|---|---|---|---|---|
| EXAMPLE 1 | 25 | 2.5 | CF | 9 × 250 | 27.8 | 3.5 | 100 | 50 | 75 |
| EXAMPLE 2 | 25 | 2.5 | CF | 9 × 1000 | 111.1 | 3.5 | 100 | 50 | 75 |
| EXAMPLE 3 | 25 | 2.5 | CF | 9 × 250 | 27.8 | 3.5 | 200 | 60 | 75 |
| EXAMPLE 4 | 30 | 2.5 | CF | 9 × 250 | 27.8 | 3.5 | 100 | 50 | 75 |
| EXAMPLE 5 | 25 | 1.5 | CF | 9 × 250 | 27.8 | 3.5 | 100 | 50 | 75 |
| EXAMPLE 6 | 25 | 2.5 | CF | 7 × 1500 | 214.3 | 2.8 | 100 | 50 | 75 |
| EXAMPLE 7 | 25 | 2.5 | CF | 10 × 25 | 2.5 | 4.2 | 100 | 54 | 75 |
| EXAMPLE 8 | 25 | 1.5 | CF | 10 × 25 | 2.5 | 5.7 | 100 | 38 | 75 |
| COMPARATIVE EXAMPLE 1 | 25 | 2.5 | CF | 9 × 18 | 2.0 | 3.5 | 100 | 50 | 75 |
| COMPARATIVE EXAMPLE 2 | 25 | 2.5 | CF | 9 × 250 | 27.8 | 4.8 | 100 | 32 | 75 |

FIG.9

| | LINEAR EXPANSION COEFFICIENT ($\times 10^{-6}$/K) OF RUBBER LAYER | SPECIFIC GRAVITY OF RUBBER LAYER | THERMAL CONDUCTIVITY λ (W/m·K) OF PRESSURE ROLLER | RATE OF CHANGE RV (%) IN CONVEYING VELOCITY | DISTORTED IMAGE |
|---|---|---|---|---|---|
| EXAMPLE 1 | 350 | 0.53 | 1.2 | 0.70 | ○ |
| EXAMPLE 2 | 300 | 0.53 | 1.8 | 0.57 | ○ |
| EXAMPLE 3 | 300 | 0.43 | 1.1 | 0.55 | ○ |
| EXAMPLE 4 | 350 | 0.53 | 1.2 | 0.60 | ○ |
| EXAMPLE 5 | 350 | 0.53 | 1.4 | 0.46 | ○ |
| EXAMPLE 6 | 240 | 0.50 | 1.2 | 0.52 | ○ |
| EXAMPLE 7 | 370 | 0.51 | 1.2 | 0.70 | ○ |
| EXAMPLE 8 | 396 | 0.69 | 1.2 | 0.65 | ○ |
| COMPARATIVE EXAMPLE 1 | 405 | 0.53 | 0.7 | 1.00 | △ |
| COMPARATIVE EXAMPLE 2 | 430 | 0.73 | 1.4 | 1.30 | × |

ROLLER USED IN FIXING DEVICE, FIXING DEVICE INCLUDING THIS ROLLER, AND IMAGE FORMING APPARATUS

BACKGROUND

Field of the Disclosure

The present disclosure relates to a roller used in a fixing device included in an image forming apparatus, such as a copying machine or a printer, using an electrophotographic method or an electrostatic recording method, a fixing device including this roller, and an image forming apparatus.

Description of the Related Art

As a fixing unit (a fixing device) included in an image forming apparatus, there is a fixing unit of a type in which a fixing nip portion is formed by a heating unit having a heat source and a pressure roller (roller) not having a heat source. A recording material on which a toner image is formed is heated while being nipped and conveyed in the fixing nip portion, and thereby the toner image is fixed to the recording material.

In such a fixing unit, a pressure roller having the following layer structure is also employed for the purpose of efficiently transmitting thermal energy from a heating unit to a recording material and toner. For example, in a pressure roller, a rubber layer is provided in which many void portions are dispersed, and thereby low thermal conduction in the rubber layer is achieved. If such a pressure roller is employed, the fixing unit reaches a temperature at which a toner image can be fixed in a short time after the warming up of the fixing unit is started. Thus, it is possible to improve a quick start property.

In the fixing unit including the pressure roller in which low thermal conduction is achieved in the rubber layer, however, the temperature rise in a sheet non-passing portion, which is an excessive temperature rise phenomenon in an area through which the recording material does not pass, is likely to occur, in a case where a fixing process is performed on a recording material of a small size.

Japanese Patent Application Laid-Open No. 2014-142406 discusses a pressure roller in which a thermal conduction filler is added to a rubber layer including many void portions to achieve both the maintenance of a quick start property and a reduction in the temperature rise in a sheet non-passing portion.

Incidentally, there are more demands to downsize an image forming apparatus and reduce cost than ever. To meet such demands, it is desirable to shorten the length of the conveying path of a recording material or simplify a conveying mechanism. As a method for such purposes, the following configuration is possible.

First, the conveying path of the recording material is designed to be as short as possible to shorten the conveying distance of the recording material. The distance from a transfer unit, which transfers an unfixed toner image to the recording material, to a fixing unit, which fixes the toner image to the recording material, also becomes as short as possible (approximately several tens of millimeters), accordingly. To simplify the conveying mechanism for the recording material, the conveyance of the recording material in the transfer unit and the fixing unit is performed by the same motor, thereby reducing the number of motors.

To achieve the above-described configuration that satisfies the downsizing and the simplification, there is the following issue. The conveyance of the recording material in the transfer unit and the fixing unit is performed by the same motor, and thereby the conveying velocity of the recording material in each unit cannot be individually adjusted. It is thus difficult to adjust both a change in the conveying velocity of the recording material in the fixing unit and a change in the conveying velocity in the transfer unit due to the difference in toner image.

In a fixing unit using a film heating method having a configuration in which a plate-like heater is placed in an inner space of a cylindrical fixing film, and a fixing nip portion is formed by the heater and a pressure roller via the fixing film, the pressure roller is rotationally driven by a motor. The fixing film rotates by being driven by the rotation of the pressure roller, and a recording material is introduced between the fixing film and the pressure roller, thereby conveying the recording material.

In the pressure roller, a rubber layer is provided. The rubber layer thermally expands by heating when printing is performed. The above-described pressure roller in which a thermal conduction filler is added to a rubber layer including many void portions also thermally expands. The degree of heating differs depending on various printing conditions, and therefore, the amount of expansion of the rubber layer also changes in various ways. With a change in the amount of expansion of the rubber layer, the diameter of the pressure roller also changes. Thus, the conveying velocity of a recording material in a fixing unit changes.

If the conveying velocity in the fixing unit is extremely faster than that in a transfer unit, and the recording material is excessively pulled, image extension in which a toner image transferred to the recording material by the transfer unit extends in the conveying direction occurs. Further, the following issue arises. A great shock occurs when the rear end of the recording material comes out of a sheet feeding unit upstream of the transfer unit in the conveying direction, and this shock is transmitted to the transfer unit and the shock disturbs the toner image.

SUMMARY OF THE DISCLOSURE

The present disclosure is directed to providing a pressure roller that reduces thermal expansion while achieving both the maintenance of a quick start property and a reduction in the temperature rise in a sheet non-passing portion, a fixing unit including this pressure roller, and an image forming apparatus including this fixing unit.

According to an aspect of the present disclosure, a roller used in a fixing device includes a rubber layer including a plurality of void portions, pore passage portions connecting the void portions, and a filler. An aspect ratio RA of the filler is $2.5 \leq RA \leq 215$, and a linear expansion coefficient of the rubber layer is less than or equal to $400 \times 10^{-6}$/K.

Further features of the present disclosure will become apparent from the following description of exemplary embodiments with reference to the attached drawings.

BRIEF DESCRIPTION OF THE DRAWINGS

FIG. 8 is a list of configurations in examples 1 to 8 and comparative examples 1 and 2, according to an embodiment of the subject disclosure.

FIG. 9 is a list of measured values and evaluation results of configurations, according to an embodiment of the subject disclosure.

DESCRIPTION OF THE EMBODIMENTS (Image Forming Apparatus)

Figure 1:
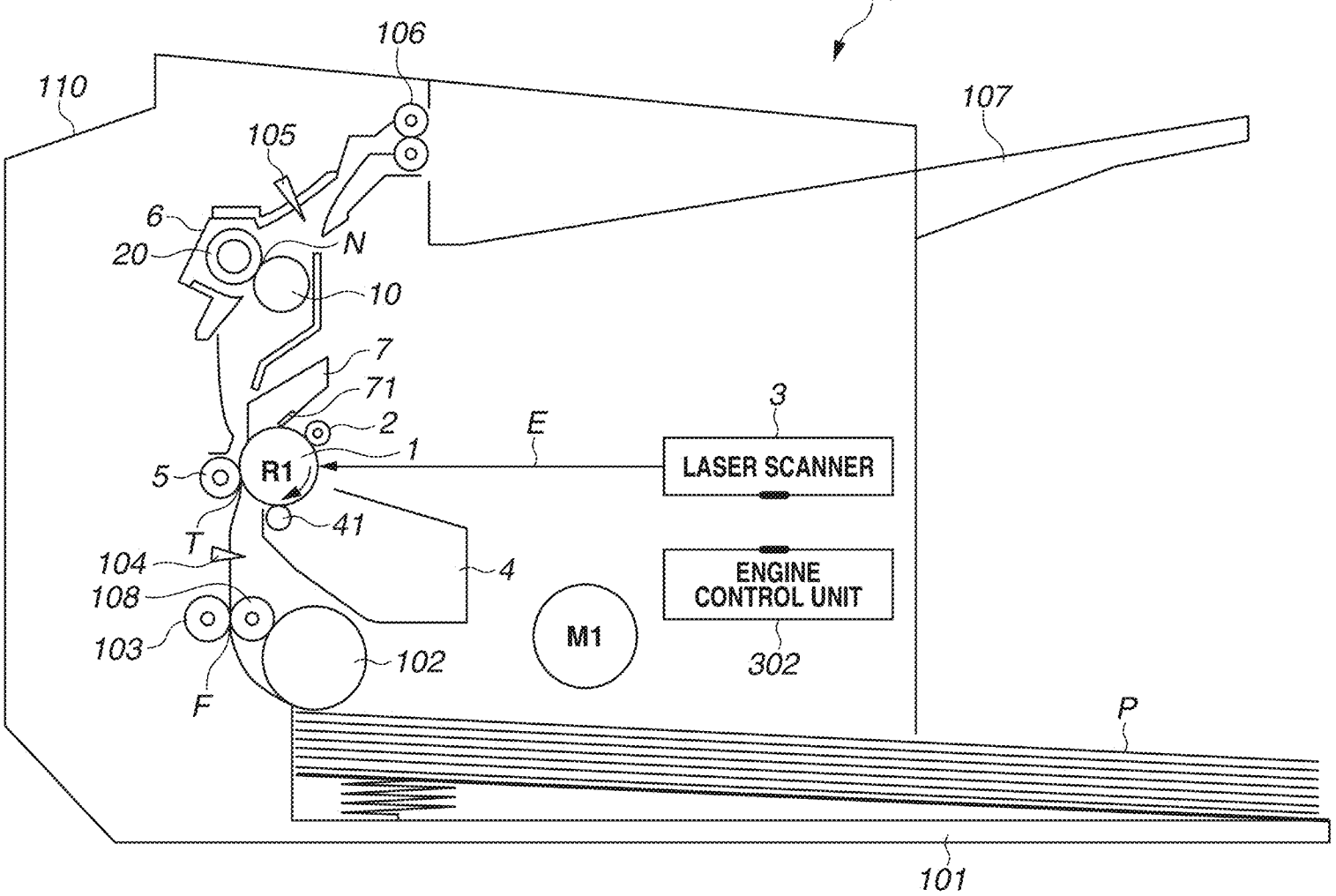
FIG. 1 is a cross-sectional view of an image forming apparatus, according to an embodiment of the subject disclosure.

FIG. 1 is a cross-sectional view of an image forming apparatus 100. The image forming apparatus 100 is a laser printer using an electrophotographic method.

The image forming apparatus 100 includes a photosensitive drum (image bearing member) 1, which is an electrophotographic photosensitive member. The photosensitive drum 1 is formed by providing a photosensitive material, such as an organic photoconductor (OPC), amorphous selenium, or amorphous silicon, on the cylindrical body of the drum formed of an aluminum alloy or nickel. The photosensitive drum 1 is rotationally driven in the direction of an arrow R1 illustrated in FIG. 1 at a predetermined process speed (peripheral velocity) by a motor M1. The surface of the photosensitive drum 1 is uniformly subjected to a charging process by a charging roller 2. The surface of the photosensitive drum 1 subjected to the charging process is scanned according to image information by a laser scanner 3. An electrostatic latent image is thereby formed on the photosensitive drum 1. The electrostatic latent image formed on the photosensitive drum 1 is developed and visualized using toner supplied from a developing unit 4. The developing unit 4 includes a developing roller 41 that conveys toner to the photosensitive drum 1.

In the image forming apparatus 100, a transfer roller 5 is placed in contact with the photosensitive drum 1. The transfer roller 5 is biased toward the photosensitive drum 1. Between the photosensitive drum 1 and the transfer roller 5, a transfer portion T is formed. At the position of the transfer portion T, a toner image is transferred from the photosensitive drum 1 to a recording material P.

Recording materials P are held in a holding tray 101, and are fed one by one by a feed roller 102. Each recording material P then passes through a conveying portion F formed by conveying rollers 103 and 108, the transfer portion T formed by the photosensitive drum 1 and the transfer roller 5, and a fixing nip portion N in this order.

The conveyance of the recording material P in the conveying portion F, the transfer portion T, and the fixing nip portion N is all performed by the driving power of the motor M1. The conveying velocity of the recording material P in each portion is set to approximately 270 mm/sec.

The front end of the recording material P is detected by a top sensor 104. Based on the positional relationship between the top sensor 104 and the transfer portion T and the conveying velocity of the recording material P, the timing when the front end of the recording material P reaches the transfer portion T is detected. The detection of this timing causes the toner image to be transferred to a correct position on the recording material P.

The recording material P to which the toner image is transferred is conveyed to a fixing unit (fixing device) 6. The fixing unit 6 heats and pressurizes, in the fixing nip portion N, the recording material P that bears the toner image, thereby fixing the toner image to the recording material P. The recording material P to which the toner image is fixed is discharged by discharge rollers 106 to a discharge tray 107 formed on an upper surface of an apparatus main body 110 of the image forming apparatus 100. Meanwhile, the discharge sensor 105 detects the timings when the front end and the rear end of the recording material P pass, thereby monitoring whether a jam occurs.

In contrast, toner remaining on the photosensitive drum 1 without being transferred to the recording material P when the toner image is transferred is removed from the photosensitive drum 1 and collected by a cleaner 7. The cleaner 7 causes a cleaning blade 71 to scrape and remove the toner from the surface of the rotating photosensitive drum 1.

(Fixing Unit)

Figure 2A:
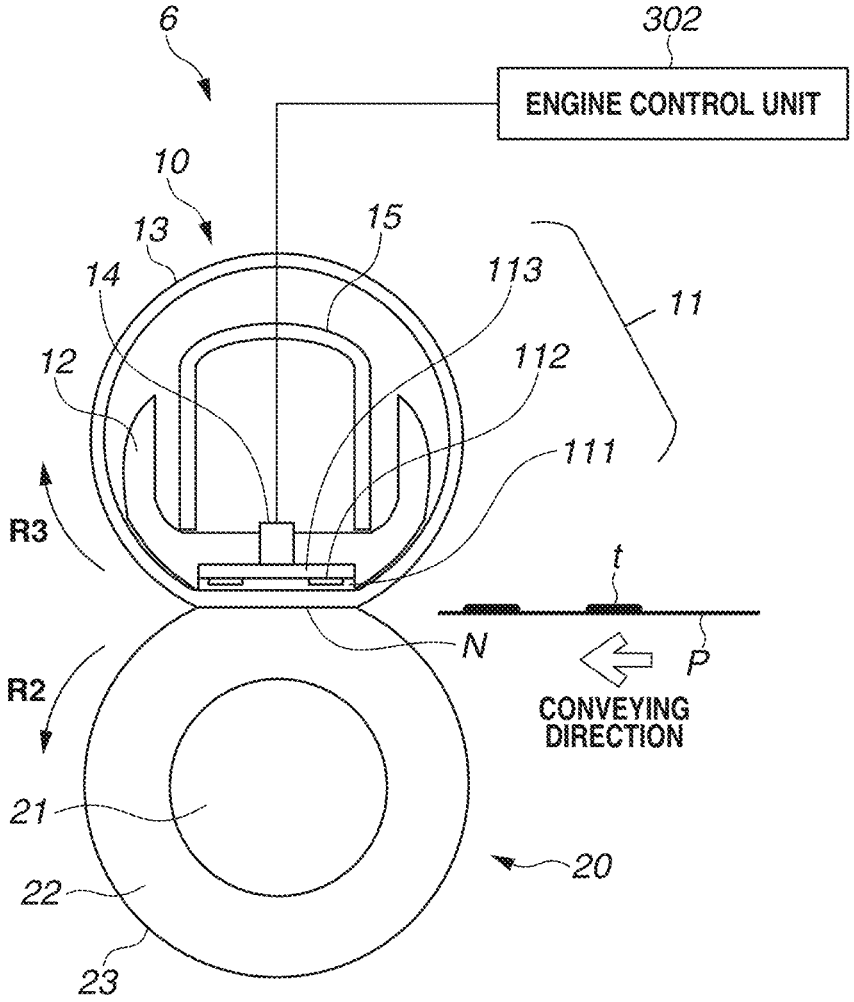
FIG. 2A is a cross-sectional view of a fixing unit.

FIG. 2A is a cross-sectional view of the fixing unit (fixing device) 6. The fixing unit 6 uses a film heating method. The fixing unit 6 includes a heating unit 10 and a pressure roller 20. The heating unit 10 includes a cylindrical fixing film 13, a heater 11 placed in an inner space of the fixing film 13, a heater holder 12 that holds the heater 11, and a reinforcement stay 15 that reinforces the heater holder 12. The heater holder 12 functions also as a guide that restricts the rotation trajectory of the fixing film 13.

The reinforcement stay 15 is biased toward the pressure roller 20 by a spring (not illustrated). The heater 11 and the holder 12, and the pressure roller 20 thereby sandwich the fixing film 13, and thus forming the fixing nip portion N between the fixing film 13 and the pressure roller 20. As described above, the pressure roller 20 is driven in the direction of an arrow R2 by the motor M1, and the fixing film 13 rotates in the direction of an arrow R3 by being driven by the pressure roller 20.

A recording material P to which a toner image t is transferred is heated while being nipped and conveyed in the fixing nip portion N. The toner image t is thereby fused by the heat of the heater 11 and fixed to the recording material P.

On the surface on the opposite side of the surface of the heater 11 with which the fixing film 13 slides in contact, a thermistor 14, which is a temperature detection element, is placed. A signal indicating the detection result of the thermistor 14 is input to an engine control unit 302. Based on the signal from the thermistor 14, the engine control unit 302 controls power to be supplied to the heater 11 such that the temperature of the heater 11 maintains a predetermined target temperature.

The heater 11 is a plate-like heater including a long and narrow plate-like substrate 113 formed of a ceramic (alumina or aluminum nitride), heat generation resistors 112 printed on the substrate 113, and an insulating layer 111 covering the heat generation resistors 112. The insulating layer 111 is provided to ensure electrical insulation properties and wear resistance. The material of the insulating layer 111 according to the present exemplary embodiment is glass.

The heater 11 is placed such that the insulating layer 111 is in contact with an inner surface of the fixing film 13.

(Fixing Film)

The fixing film 13 includes a base layer formed of a metal such as stainless steel or a heat resistant resin such as polyimide, and a release layer formed on the base layer. The release layer is formed of a fluororesin, such as tetrafluoroethylene-polyethylenefluorovinyl ether copolymer (PFA), tetrafluoroethylene-hexafluoropropylene copolymer (FEP), or polytetrafluoroethylene (PTFE). The release layer can be formed by coating the surface of the base layer with a fluororesin directly or via a primer layer, or placing a fluororesin tube on the base layer. The fixing film 13 according to the present exemplary embodiment is a film in which a release layer is formed by coating a base layer of polyimide with PFA. The total thickness of the fixing film 13 according to the present exemplary embodiment is 70 μm, and the outer circumferential length of the fixing film 13 is 56.7 mm.

Since the fixing film 13 rotates in sliding contact with the heater 11 and the heater holder 12, it is desirable to reduce the frictional resistance between the heater 11 and the heater holder 12, and the fixing film 13. Thus, an appropriate amount of lubricant such as heat resistant grease is interposed between the surfaces of the heater 11 and the holder 12 and the inner circumferential surface of the fixing film 13. This enables the fixing film 13 to rotate smoothly.

(Pressure Roller)

Figure 2B:
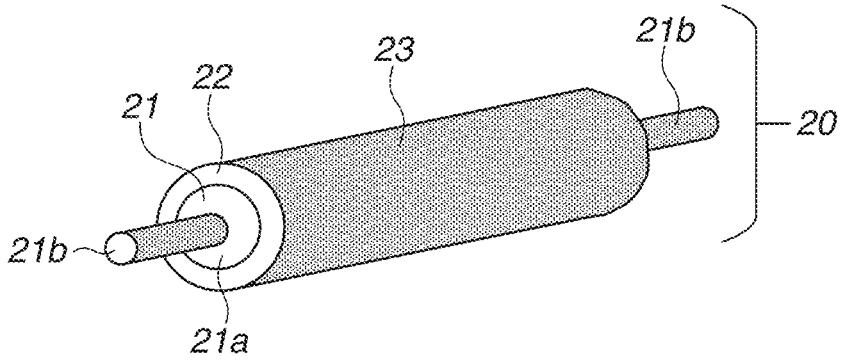
FIG. 2B is a perspective view of a pressure roller, according to an embodiment of the subject disclosure.

FIG. 2B is a perspective view of the pressure roller 20. The pressure roller 20 includes a metal core 21 including a main body portion 21*a* and shaft portions 21*b*, a rubber layer 22 provided around the metal core 21, and a release layer 23 provided around the rubber layer 22. The rubber layer 22 of the pressure roller 20 according to the present exemplary embodiment is formed of silicone rubber, and the release layer 23 is formed of a fluororesin. The diameter of the pressure roller 20 is 20 mm, and the thickness of the rubber layer 22 is 2.5 mm. The diameter of the main body portion 21*a* of the metal core 21 is 15 mm. The length in the axial direction (the entire length including the shaft portions 21*b*) of the pressure roller 20 is 289 mm. The length of a portion where the rubber layer 22 is provided (the length of the main body portion 21*a* of the metal core 21) is 250 mm.

As details will be described below, the rubber layer 22 formed of silicone rubber includes void portions, pore passage portions connecting the void portions, and a needle-like filler (a high thermal conductive filler).

(Metal Core)

As a metal core of a pressure roller, a solid metal core or a hollow pipe-shaped metal core is known. In the case of the hollow pipe-shaped metal core, a heating element may also be placed within the hollow pipe-shaped metal core. As the metal core 21 of the pressure roller 20 according to the present exemplary embodiment, both a solid metal core and a hollow pipe-shaped metal core can be used. It is, however, desirable not to place a heating element within the metal core 21. This is to achieve a configuration for promoting heat dissipation from the rubber layer 22 via the metal core 21 to prevent the temperature rise in a sheet non-passing portion.

The metal core 21 can be composed of a metal material such as aluminum, an aluminum alloy, steel, or a stainless steel alloy. The metal core 21 of the pressure roller 20 according to the present exemplary embodiment is solid and made of steel, and the metal core 21 includes the shaft portions 21*b* in its both end portions in the axial direction.

(Rubber Layer)

Figure 3:
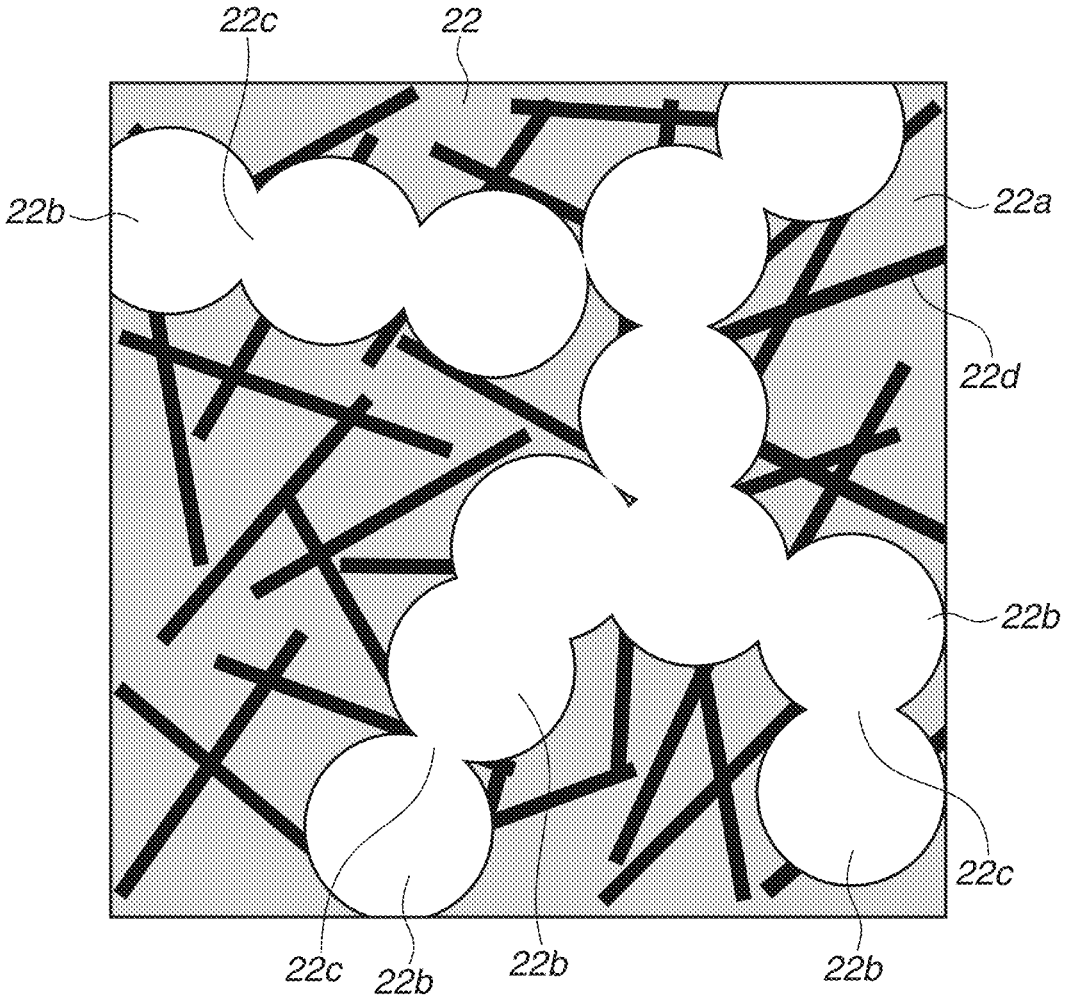
FIG. 3 is a schematic cross-sectional view of a rubber layer of the pressure roller, according to an embodiment of the subject disclosure.

FIG. 3 is a cross-sectional view illustrating the microscopic structure of the rubber layer 22. The main component of the rubber layer 22 is heat resistant silicone rubber 22*a*. The rubber layer 22 includes within the silicone rubber 22*a* a plurality of dispersed void portions 22*b*, pore passage portions 22*c* connecting the void portions 22*b*, and a dispersed needle-like filler 22*d*. That is, the void portions 22*b* of the rubber layer 22 have a structure where adjacent void portions 22*b* among the plurality of void portions 22*b* are connected to each other by pore passage portions 22*c* (communicating pores). The silicone rubber 22*a* of the rubber layer 22 contains a silane coupling agent or an adhesive. This integrates the rubber layer 22 with the metal core 21. The rubber layer 22 will be described in detail below.

(Release Layer)

The main component of the release layer 23 is a fluororesin. As the fluororesin, PFA, FEP, PTFE, the mixtures of these, or products obtained by dispersing these polymers in a heat resistant resin or rubber can be applied. As the release layer 23 of the pressure roller 20 according to the present exemplary embodiment, a resin tube formed of PFA is used.

Figure 4:
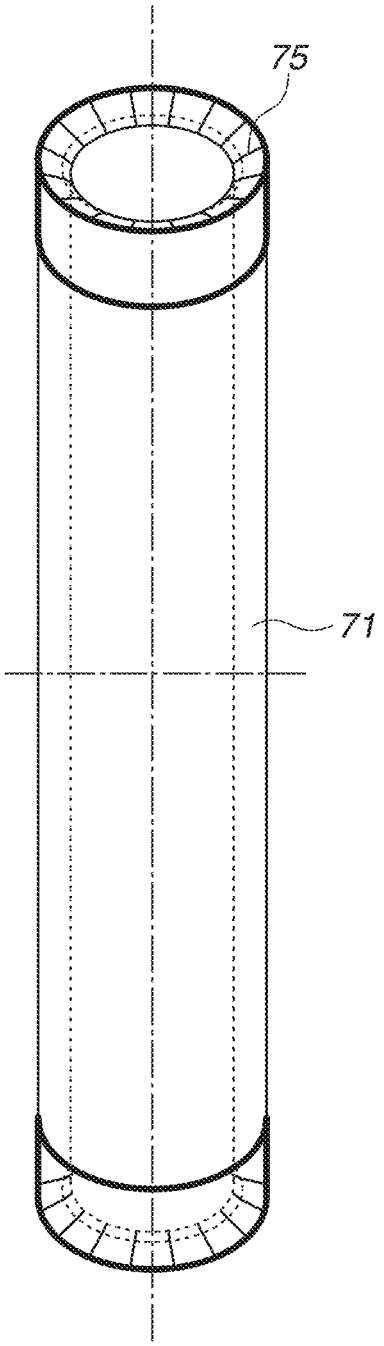
FIG. 4 is a schematic perspective view of a mold for molding the pressure roller, according to an embodiment of the subject disclosure.

Examples of a method for molding the release layer 23 composed of the resin tube include a method for molding the rubber layer 22 and then fixing the resin tube to the outer circumference of the rubber layer 22 with an adhesive, and a method for placing the resin tube within a cylindrical outer mold and bonding the resin tube to the rubber layer 22 simultaneously with the molding of the rubber layer 22. In the present exemplary embodiment, the following method is used. As illustrated in FIG. 4, a resin tube 75 is placed within a cylindrical outer mold 71, and the resin tube 75 is fixed in opening portions at both ends in the longitudinal direction of the outer mold 71. Then, the resin tube 75 (which will eventually become the release layer 23) and the rubber layer 22 are integrated together simultaneously with the molding of the rubber layer 22. FIG. 4 illustrates the state where the resin tube 75 placed within the cylindrical outer mold 71 is fixed in the opening portions of the outer mold 71 in a fold-back manner. A method for manufacturing the pressure roller 20 will be described in detail below.

The thickness of the release layer 23 is 100 μm or less. It is desirable that the thickness of the release layer 23 should be 10 μm or more and 50 μm or less. If the thickness of the release layer 23 is too great, the hardness of the pressure roller 20 may be high, and the fixing nip portion N may not be able to be formed with a desired width. The thickness of the release layer 23 of the pressure roller 20 according to the present exemplary embodiment is 30 μm.

(Detailed Description of Rubber Layer)

The configuration of the rubber layer 22 will now be described in detail. The rubber layer 22 has the following microscopic structure, whereby it is possible to reduce a change in the conveying velocity of the recording material in the fixing unit 6.

(Silicone Rubber)

It is desirable that the silicone rubber 22*a* should be formed of a silicone rubber raw material that cures by heat and has rubbery elasticity. The type of the silicone rubber raw material, however, is not particularly limited. Examples of the silicone rubber raw material include (1) an addition reaction curing type liquid silicone rubber composition that is composed of alkenyl group-containing diorganopolysiloxane, silicon atom-binding hydrogen atom-containing organohydrogenpolysiloxane, and a reinforcing filler, and cures with a platinum catalyst, thereby becoming silicone rubber, (2) an organic peroxide curing type silicone rubber composition that is composed of alkenyl group-containing diorganopolysiloxane and a reinforcing filler, and cures with an organic peroxide, thereby becoming silicone rubber, and (3) a condensation reaction curing type liquid silicone rubber composition that is composed of hydroxyl group-containing diorganopolysiloxane, silicon atom-binding hydrogen atom-containing organohydrogenpolysiloxane, and a reinforcing filler, and cures with a condensation reaction accelerating catalyst such as an organic tin compound, an organic titanium compound, or a platinum catalyst, thereby becoming silicone rubber.

Among these, the addition reaction curing type liquid silicone rubber composition is desirable in terms of processing moldability. For example, if the viscosity at 25° C. of a liquid material of which the main component is diorganopolysiloxane as a starting material is 0.1 Pa·S or more, a rubber molded product can be easily obtained using a processing method such as a known metal mold casting method. As such liquid silicone rubber, commercially available liquid silicone rubber can be employed. As well as materials to be blended as described below, a thickening agent or a reinforcing agent can be added as needed.

(Void Portions)

Most of the void portions 22*b* of the rubber layer 22 are so-called communicating pores communicating with the outside of the pressure roller 20 via pore passage portions 22*c*. In the pressure roller 20 according to the present exemplary embodiment, the outer circumference of the rubber layer 22 is covered by the release layer 23, but the rubber layer 22 is exposed to outside in both end portions in the axial direction of the pressure roller 20. In a porous rubber layer having a communicating pore structure, it is easier for air present in void portions to flow out of the void portions than in a porous rubber layer that does not have a communicating pore structure (i.e., has an independent pore structure). For example, if the pressure roller 20 is heated, air thermally expanded within the void portions 22*b* of the rubber layer 22 is exhausted to outside via the pore passage portions 22*c*, thereby preventing a change in the diameter of the pressure roller 20.

Examples of a method for forming the void portions 22*b* having such a communicating pore structure include a method of using a thermally decomposable organic blowing agent simultaneously with the cross-linking of a rubber component by heating, and a method of using an emulsified product obtained by mixing a non-cross-linked material of the liquid silicone rubber and water with a thickening agent, an emulsifying agent, or the like. In the present exemplary embodiment, the void portions 22*b* of the rubber layer 22 are formed using resin microballoons that are hollow particles dispersed in the liquid silicone rubber. That is, the void portions 22*b* are void portions derived from the resin microballoons. A resin microballoon flocculant having high affinity with the resin microballoons and having less affinity with the silicone rubber material is added, whereby the pore passage portions 22*c* can be formed simultaneously with hot molding.

As the resin microballoons, various types of resin microballoons are available. In the present exemplary embodiment, pre-expanded resin microballoons (product name: F80-DE, manufactured by MASTUMOTO YUSHI-SEIYAKU CO., LTD.) including acrylonitrile shells and having an average particle diameter of 10 to 200 μm were used, in view of dispersiveness in the liquid silicone rubber, dimensional stability in molding, and the ease of handling.

The amount of blending of the resin microballoons with the liquid silicone rubber can be appropriately selected in view of the specific gravity of the compact. The amount of blending of the resin microballoons is typically 0.5 to 8 parts by weight with respect to 100 parts by weight of the liquid silicone rubber. It is desirable that the amount of blending of the resin microballoons should be 1 parts by weight to 5 parts by weight. If the amount of blending of the resin microballoons is less than 1 parts by weight, the specific gravity of the compact may be high and the compact may be hard. Further, the formation of the pore passage portions 22*c* according to the addition of the flocculant may be unstable. If the amount of blending of the resin microballoons is greater than 5 parts by weight, the bulk of the resin microballoons may be great, and special consideration may need to be given to the blending with the liquid silicone rubber.

As the flocculant, tetraethylene glycol was used in the present exemplary embodiment. The amount of addition of the flocculant to the liquid silicone rubber is approximately 3 parts by weight to 15 parts by weight with respect to 100 parts by weight of the liquid silicone rubber, although depending on the amount of blending of the resin microballoons with respect to the liquid silicone rubber. If the amount of addition of the flocculant is less than 3 parts by weight, there may be many isolated void portions 22*b* that do not communicate with each other. If the amount of addition of the flocculant is greater than 15 parts by weight, heat moldability may be low.

It is desirable that the volume ratio of the communicating void portions 22*b* (communicating pores) should be 35 volume percent or more and 65 volume percent or less with respect to the volume of the entirety of the rubber layer 22. If the volume ratio of the void portions 22*b* is less than 35 volume percent, the rubber layer 22 may be too hard to form the fixing nip portion N. If the volume ratio of the void portions 22*b* is 65 volume percent or more, the durability of the rubber may be low. All the void portions 22*b* of the rubber layer 22 are not necessarily communicating pores, and the rubber layer 22 may include independent pores.

(Needle-Like Filler)

The needle-like filler 22*d* is dispersed in an almost random state in the silicone rubber 22*a*. As will be described in detail below, the rubber layer 22 is molded by injecting a liquid material including the needle-like filler 22*d* into a metal mold and causing the liquid material to flow. At this time, the needle-like filler 22*d* having a high aspect ratio is often oriented according to the flow. In a case where hollow particles (a hollow filler) are used as a material for forming the void portions 22*b*, the needle-like filler 22*d* can be prevented from being oriented in the flow direction. It is considered that this is because the hollow particles act as so-called disturbing particles. Thus, in a case where hollow particles are present when the rubber layer 22 is molded, relatively more connecting paths due to contact between fibers of the needle-like filler 22*d* are formed in the thickness direction of the rubber layer 22 than in a case where hollow particles are not present. That is, the heat conductivity in the thickness direction of the rubber layer 22 improves.

Examples of the needle-like filler 22*d* include pitch carbon fibers, polyacrylonitrile (PAN) carbon fibers, glass fibers, and inorganic whiskers. In a case where carbon fibers having high thermal conductivity are used as the needle-like filler 22*d*, the above connecting paths function as thermal conduction paths, and the heat conductivity in the thickness direction of the rubber layer 22 improves as compared with a case where hollow particles are not present. Then, the rubber layer 22 is laminated on the metal core 21 made of a metal as described above and therefore can effectively transfer heat accumulated in a sheet non-passing portion of the pressure roller 20 to the metal core 21 via the thermal conduction paths.

A needle-like filler (or a fibrous filler) refers to a filler having a needle-like (or fibrous) shape that is long in a single direction.

An aspect ratio (length/diameter) RA of the filler used in the present exemplary embodiment is $2.5 \leq RA \leq 215$.

The reason for this definition is that the use of a needle-like filler having a high aspect ratio can reduce the thermal expansion of the silicone rubber 22*a*. However, the higher the aspect ratio (the longer the length) is, the more difficult it is to form a uniform rubber layer in manufacturing. In view of these circumstances, it is desirable that the fiber length of the filler should be 25 μm or more and 1500 μm or less, and the fiber diameter of the filler should be 7 μm or more and 10 μm or less. As described above, it is desirable that the aspect ratio RA of the filler should be $2.5 \leq RA \leq 215$. It is more desirable that the fiber length should be about 200 μm or more and 1100 μm or less.

In the present exemplary embodiment, as the needle-like filler 22*d*, pitch carbon fibers exhibiting high heat conductivity (product name: GRANOC Milled Fiber XN-100-25M (manufactured by NIPPON GRAPHITE FIBER CORPORATION), a fiber diameter of 9 μm, an average fiber length of 250 μm, an aspect ratio of 28, a density of 2.2 g/cm$^3$) were used. A thermal conductivity λ of the pressure roller 20 was approximately 0.8 to 2.0 W/m·K as a result of measurement. Within this range, the amount of blending of the needle-like filler 22*d* could be reduced while exerting the effect of preventing the temperature rise in a sheet non-passing portion. Thus, it was not difficult to mold the pressure roller 20.

The thermal conductivity k of the pressure roller 20 was measured by bringing a surface thermal conductivity meter (product name: QTM-500, manufactured by KYOTO ELECTRONICS MANUFACTURING CO., LTD.) into contact with the surface of the pressure roller 20. A sensor probe (model: PD-11, manufactured by KYOTO ELECTRONICS INDUSTRY CO., LTD.) of the surface thermal conductivity meter was brought into contact with the pressure roller 20 approximately parallel to the axial direction of the pressure roller 20. In the measurement, the sensor probe was used by calibrating the sensor probe with a cylindrical body made of quartz having the same diameter as that of the pressure roller 20.

(Method for Manufacturing Pressure Roller)

Figure 5:
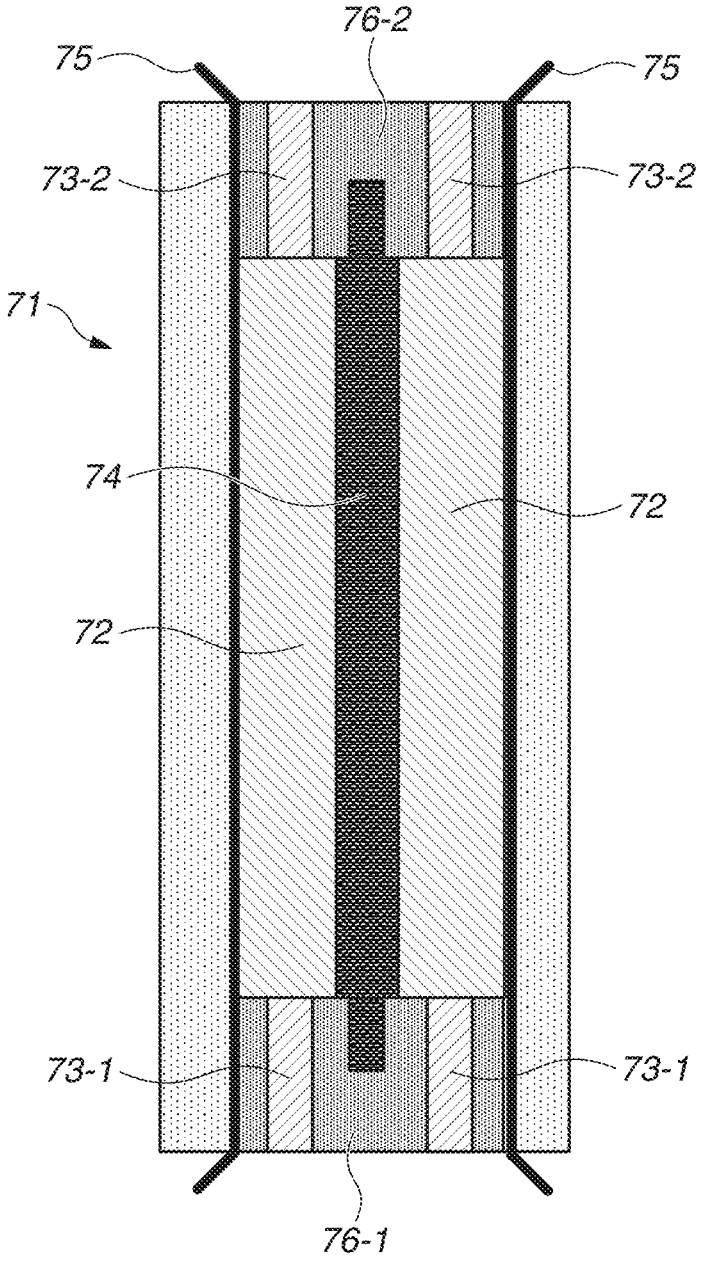
FIG. 5 is a schematic cross-sectional view of the mold for molding the pressure roller, according to an embodiment of the subject disclosure.

The method of manufacturing the pressure roller 20 will now be described. FIG. 4 is an external perspective view of a mold for cast molding used to manufacture the pressure roller 20. FIG. 5 is a cross-sectional view along the axial direction of the pressure roller 20. The pressure roller 20 may be manufactured by another manufacturing method. In experimental examples described below, a plurality of pressure rollers 20 was created and used for evaluation.

(Step of Preparing Liquid Composition for Rubber Layer (First Step))

A needle-like filler and resin microballoons were weighed and blended with non-cross-linked addition reaction curing type liquid silicone rubber. The needle-like filler, the resin microballoons, and the non-cross-linked addition reaction curing type liquid silicone rubber were mixed together using a known mixture agitation method such as an epicyclic versatile mixture agitator. Next, tetraethylene glycol was added as a flocculant for the resin microballoons, and the mixture was continued for a certain time, thereby preparing a liquid composition for a rubber layer.

(Step of Molding Rubber Layer (Second Step))

As illustrated in FIG. 4, a fluororesin tube 75 was firmly fixed to the inside of a cylindrical outer mold 71 made of a metal and having a length in the longitudinal direction of the mold for cast molding (the axial direction of the pressure roller 20) of 250 mm, a diameter of 28 mm, and an inner diameter of 20 mm. The above dimensions are the dimensions of portions corresponding to the main body portion 21*a* of the metal core 21, the rubber layer 22, and the release layer 23 in the pressure roller 20.

As illustrated in FIG. 5, a cavity 72 of the mold for cast molding was formed by the fluororesin tube 75 on the inner circumferential surface of which a primer process was performed and a metal core 74 on the surface of which a primer process was performed and which had a diameter of 15 mm. The metal core 74 was supported by the outer mold 71 using bearings 76-1 and 76-2. The cavity 72 communicated with the outside of the outer mold 71 through communication paths 73-1 and 73-2. The liquid composition for the rubber layer prepared in the first step was then injected from the communication path 73-1, which was a flow path, thereby filling the inside of the cavity 72 with the liquid composition. The cavity 72 filled with the liquid composition for the rubber layer was then sealed by a sealing method (not illustrated). The metal core 74 corresponds to the metal core 21 of the pressure roller 20.

(Step of Cross-Linking Silicone Rubber Component (Third Step))

The mold for cast molding in which the cavity 72 was sealed was heated at 130° C. for 60 minutes, thereby curing the silicone rubber component of the rubber layer.

(Demolding Step (Fourth Step))

After the mold for cast molding was appropriately cooled by water cooling or air cooling, the pressure roller 20 in which the metal core 21, the rubber layer 22, and the release layer 23 were integrated together was taken out of the mold for cast molding.

(Secondary Cross-Linking Step (Fifth Step))

The pressure roller 20 taken out of the mold for cast molding was placed in a hot air circulation oven and held at a temperature of 230° C. for four hours, thereby being secondarily cross-linked.

(Evaluation Method)

An evaluation method for evaluating the pressure roller 20 will now be described.

(Method of Evaluating Change in Conveying Velocity of Recording Material in Fixing Unit)

By using the following method, the effect of reducing a change in the conveying velocity of the recording material using the pressure roller 20 was confirmed.

To evaluate the conveying velocity of the recording material P only in the fixing unit 6, a test was performed in the state where the fixing unit 6 was removed from the image forming apparatus 100 and set in a so-called idling apparatus, which can be rotationally driven, adjust the temperature, and pass a recording material.

Test procedures are as follows.

Procedure 1: The fixing unit 6 was cooled to the same temperature as the outside air temperature (in the present exemplary embodiment, the state where the entirety of the fixing unit 6 reached 25° C.).

Procedure 2: The rotational driving of the pressure roller 20 was started so that the peripheral velocity of the pressure roller 20 reached 270 mm/sec, and simultaneously, heating control was started in which the target temperature of the temperature control of the heater 11 was 200° C.

Procedure 3: 3 seconds after the start of the rotational driving and the heating control, a single A4-size sheet of CANON Red Label 80 g/cm$^2$ was passed as the recording material P, and the paper velocity of the sheet (the paper velocity in procedure 3 was VP1) was measured. Although the paper velocity could be measured by various methods, the paper velocity was measured using a laser Doppler measuring device in the present exemplary embodiment.

Procedure 4: After the recording material P was passed as described in procedure 3, the state where the peripheral velocity of the pressure roller 20 was 270 mm/sec and the temperature was adjusted to 200° C. was maintained for 120 seconds (120 seconds of idling).

Procedure 5: Similarly to procedure 3, a single A4-size sheet of CANON Red Label 80 g/cm$^2$ was passed, and the paper velocity of the sheet was measured (the paper velocity in procedure 5 was VP2).

By executing the above test, the conveying velocity of the recording material P in the fixing unit 6 in the state where the temperature of the pressure roller 20 is the lowest temperature and the state where the temperature of the pressure roller 20 is the highest temperature can be measured, in a case where the image forming apparatus 100 actually performs printing. The contents of the above procedures were determined based on the state of the fixing unit 6 when the image forming apparatus 100 performed printing.

In a case where the image forming apparatus 100 performs printing, the temperature of the pressure roller 20 is lowest when the first sheet is printed, because the printing is started in the state where the fixing unit 6 is completely cooled. Thus, the velocity of the recording material P at this time is lowest. In the image forming apparatus 100 according to the present exemplary embodiment, the time when the first recording material P reaches the fixing unit 6 when the printing is started is 3 seconds after the rotational driving of the fixing unit 6 and the heating operation of the heater 11 are simultaneously started. Conditions for procedure 3 are adjusted to the actual conditions of the image forming apparatus 100 when the first sheet is fixed. The surface temperature of the pressure roller 20 when the sheet is passed is 130° C.

In contrast, the temperature of the pressure roller 20 is highest when the printing of sheets one by one is intermittently repeated, in a case where the image forming apparatus 100 performs printing. In the image forming apparatus 100 according to the present exemplary embodiment, the temperature of the pressure roller 20 continues to rise until the intermittent printing of 100 sheets one by one is completed. For example, the surface temperature of the pressure roller 20 is saturated at 180° C. when the hundredth sheet and the subsequent sheets are printed in a case where sheets of CANON Red Label 80 g/cm$^2$ are printed. Thus, the velocity of the recording material P at this time is highest.

Conditions of procedure 5 is adjusted to the actual conditions of the image forming apparatus 100 when the hundredth sheet and the subsequent sheets are fixed. The surface temperature of the pressure roller 20 is 180° C. when the sheets are passed.

Procedures 1 to 5 were thus executed, and the paper velocity VP1 in procedure 3 and the paper velocity VP2 in procedure 5 were measured, and thereby the maximum rate of change VP2/VP1 (=RV) in the conveying velocity of the recording material in the fixing unit 6 in the image forming apparatus 100 is measured.

(Method of Evaluating Image)

A method of evaluating an image defect caused by a change in the conveying velocity of the recording material in the fixing unit 6 will now be described.

In the image forming apparatus 100, as illustrated in FIG. 1, the rotational driving of the conveying portion F, the transfer portion T, and the fixing nip portion N is all performed by the motor (common motor) M1, and the conveying velocity of the recording material P in each portion is configured to be approximately 270 mm/sec. If, however, the temperature of the pressure roller 20 becomes high, the conveyance velocity of the recording material P in the fixing nip portion N is faster than 270 mm/sec. In the state where the temperature of the pressure roller 20 is high, and if a single recording material P is simultaneously nipped by the conveying portion F, the transfer portion T, and the fixing nip portion N, the recording material P is conveyed in the state where the recording material P is pulled together between the fixing nip portion N and the conveying portion F, and the transfer portion T.

If the conveyance of the recording material P proceeds, the rear end of the recording material P comes out of the conveying portion F. At this moment, however, the balance between the forces to pull the recording material P together as described above is lost. Thus, the relative velocity of the recording material P to the peripheral velocity of the photosensitive drum 1 greatly fluctuates for a moment in the transfer portion T. This fluctuation for a moment in the relative velocity causes disturbance (blurring) in a toner image (hereinafter referred to as a "distorted image") that is being transferred from the photosensitive drum 1 onto the recording material P.

Figure 6:
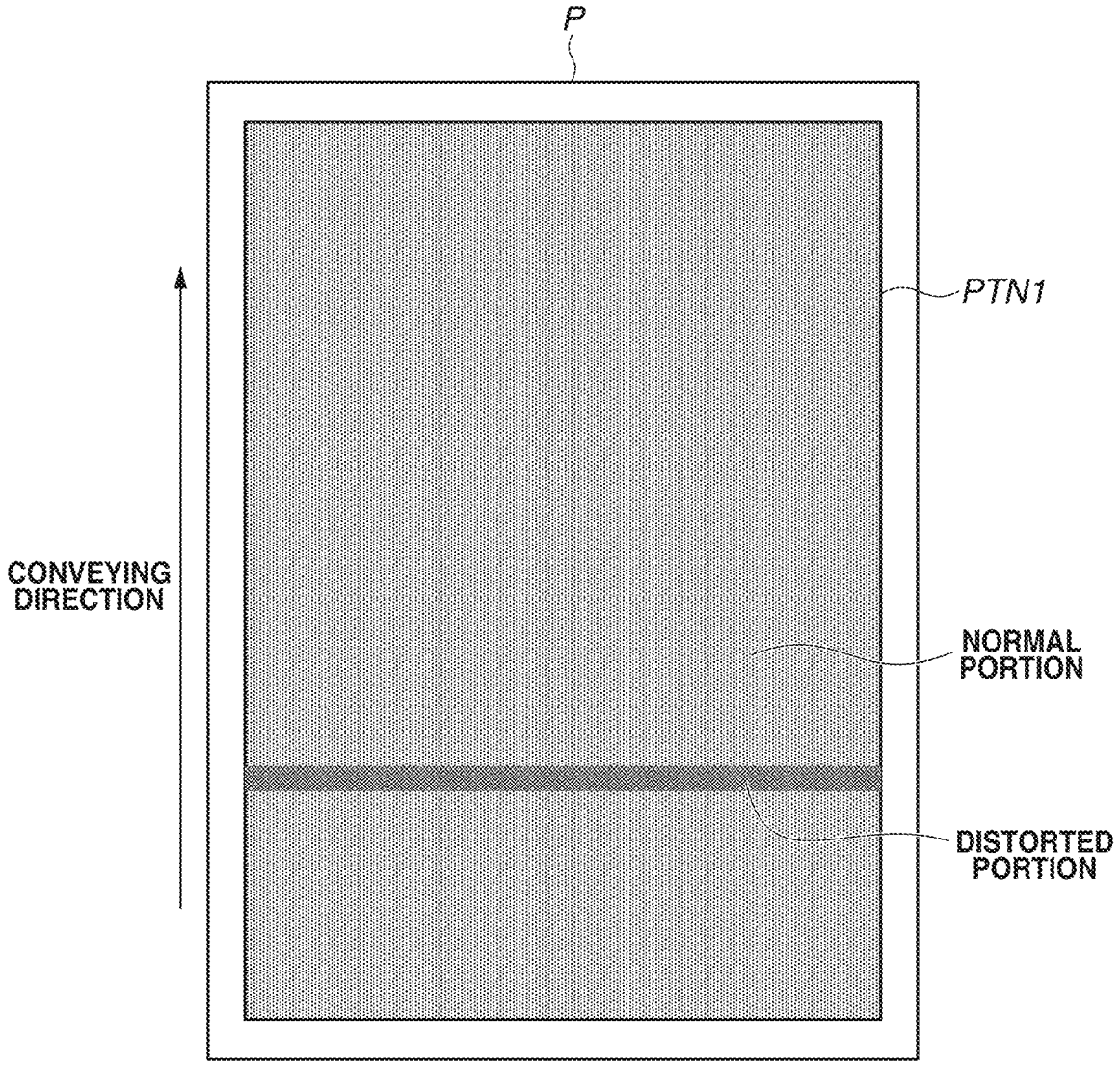
FIG. 6 is an example of a distorted image, according to an embodiment of the subject disclosure.

FIG. 6 illustrates an example of the distorted image. In FIG. 6, a horizontal line image PTN1 (a line width of one dot and a space of two dots) is printed on the entire surface of the recording material P. A distorted portion is a portion where disturbance occurs in the toner image that is being transferred. The distorted portion looks darker than a normal portion.

Figure 7A:
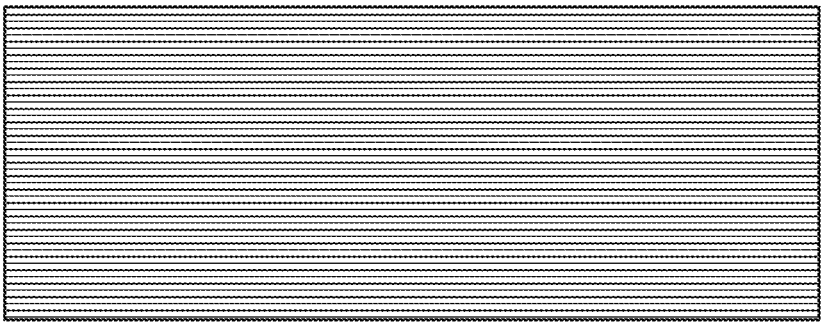
FIG. 7A is an enlarged view of a normal portion of an image on a recording material, according to an embodiment of the subject disclosure.
Figure 7B:
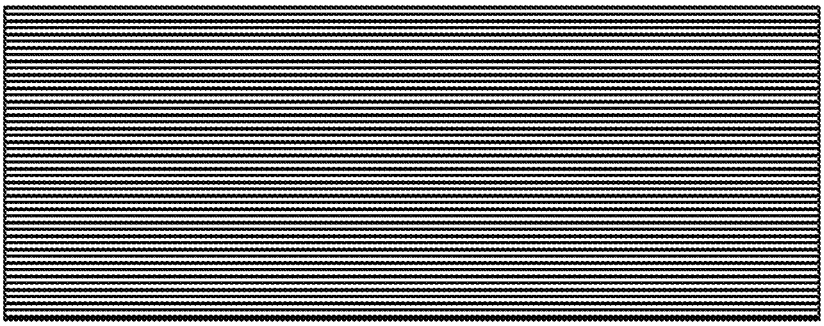
FIG. 7B is an enlarged view of a distorted portion of the image on the recording material, according to an embodiment of the subject disclosure.

FIGS. 7A and 7B illustrate enlarged views of the normal portion and the distorted portion illustrated in FIG. 6. FIG. 7A is an enlarged view of the normal portion, and FIG. 7B is an enlarged view of the distorted portion. FIGS. 7A and 7B both illustrate images formed of horizontal lines having a width of one dot (lines long in a direction orthogonal to the conveying direction) and a space of two dots in the conveying direction. It can be confirmed that in the distorted portion in FIG. 7B, the line width is greater than that in the normal portion, and the lines spread thickly.

In this case, the image forming apparatus 100 intermittently printed the image PTN1 in FIG. 6 on 100 sheets one by one, and the occurrence state of a distorted image on the hundredth sheet was evaluated. If there was no distorted portion at all, the occurrence state was evaluated as "○". If there was a distorted portion, but the distortion was minor (the distorted portion could be distinguished on closer look), the occurrence state was evaluated as "Δ". If a distortion was worse than the minor distortion (it was understandable at a glance that there was apparently a distorted portion), the occurrence state was evaluated as "x".

In the image forming apparatus 100 according to the present exemplary embodiment, a distorted image corresponding to the level "Δ" starts to occur if the maximum rate of change RV in the foregoing conveying velocity of the recording material exceeds 1.0%.

(Configurations of Pressure Roller)

Examples of the pressure roller 20 will now be described by comparing the examples with comparative examples. FIG. 8 illustrates the configurations of the pressure roller used in examples 1 to 8 and comparative examples 1 and 2. Items include the diameter of the pressure roller 20, the thickness of the rubber layer 22, the type, the size (diameter× length), the aspect ratio RA, and the amount of addition of the filler, and the size, the amount of addition, and the communication rate of the resin microballoons.

The communication rate of the resin microballoons indicates the ratio of the volume of communicating voids to the volume of voids calculated from the size of the resin microballoons and the amount of addition of the resin microballoons. If the amount of addition of the resin microballoons is the same, the greater the value of the communication rate is, the less likely the rubber layer 22 is to thermally expand.

In these comparisons, the communication rate is fixed to 75% in all the configurations for ease of description. The type of the filler is pitch carbon fibers (hereinafter referred to as "CF") in all the configurations. As the filler, a needle-like filler having high thermal conductivity, such as glass fibers, may be used instead of the CF.

FIG. 9 illustrates the linear expansion coefficient and the specific gravity of the rubber layer 22, the thermal conductivity λ of the pressure roller 20, the rate of change RV in the conveying velocity of the recording material P, and the confirmation result of the occurrence of a distorted image, in the configurations illustrated in FIG. 8. The contents and the evaluation results of the configurations will be described with reference to FIGS. 8 and 9.

In example 1, the pressure roller 20 has a diameter of 25 mm, and the thickness of the rubber layer 22 is 2.5 mm. The rubber layer 22 is formed in the liquid silicone rubber by containing the carbon fibers (CF) as the filler and the resin microballoons for creating the void portions. The sizes of the carbon fibers (CF) in example 1 are a fiber diameter of 9 μm, an average length of 250 μm, and an aspect ratio RA of 27.8. These carbon fibers (CF) are added such that the carbon fibers (CF) are 3.5 volume percent of the rubber layer 22.

The resin microballoons having a size (diameter) of 100 μm are added such that the resin microballoons are 50 volume percent of the rubber layer 22. Similarly to the above method, the void portions are caused to communicate with each other using tetraethylene glycol as a flocculant, and thereby a communication rate of 75% is obtained. With the above configuration, the following effect is obtained.

The aspect ratio RA of the carbon fibers (CF) that are used is 27.8, and therefore, the carbon fibers (CF) has a high aspect ratio. Thus, the effect of reducing the thermal expansion of the silicone rubber due to heating when printing is performed is obtained. It is considered that this is because the linear expansion coefficient of the carbon fibers (CF) is only about 1/100 of the silicone rubber, and thus, the carbon fibers (CF) having a high aspect ratio reduce the expansion of silicone rubber near the carbon fibers (CF).

Further, since communicating voids are created by the resin microballoons, the rubber layer 22 is less likely to thermally expand.

That is, in the configuration in example 1, the carbon fibers (CF) having a high aspect ratio reduce the actual expansion of the structure other than the void portions, and the communicating voids are provided in addition to this, thereby further reducing the thermal expansion of the entirety of the rubber layer 22. According to the consideration of the present writers, it is understood that the above-described effect can be obtained in a case where the fiber length of the filler is approximately 25 prn or more.

Since the fiber diameter of the filler is about 7 to 10 μm, it is desirable that the aspect ratio RA should be 2.5 or more. It is understood that to stably manufacture the rubber layer 22 having a uniform structure as described above, it is desirable that the aspect ratio RA should be 215 or less. Thus, in examples 1 to 8, the value of the aspect ratio RA of the filler is $2.5 \leq RA \leq 215$.

In contrast, the amount of communicating voids can be represented by the specific gravity of the rubber layer 22. To obtain the above effect of reducing the thermal expansion, it is desirable that the specific gravity of the rubber layer 22 should be 0.70 or less. As illustrated in FIG. 9, the specific gravity of the rubber layer 22 is 0.70 or less in examples 1 to 8.

In examples 1 to 8, where the aspect ratio RA of the filler and the specific gravity of the rubber layer 22 are within the above ranges, it is further understood that the linear expansion coefficient of the rubber layer 22 is 400 ($\times 10^{-6}$/K) or less.

As illustrated in FIG. 9, in example 1, with the above configuration, the maximum rate of change RV in the conveying velocity of the recording material is reduced to 0.70%, which is less than 1.0%. As a result, the occurrence of a distorted image can be prevented.

The thermal conductivity λ of the pressure roller 20 is 1.2 W/m·K, which is within the above-described range of 0.8 [W/m·K]≤λ≤2.0 [W/m·K]. Thus, a temperature rise in a sheet non-passing portion that exceeds a heat-resistant temperature and delay in First Print Output Time (FPOT) do not occur.

The features and the evaluation results of examples 2 to 8 will now be described in order.

Example 2 has a configuration in which the average length of the carbon fibers (CF) is changed to 1000 μm, whereby the aspect ratio RA is 111.1. The other items in FIG. 8 are similar to those in example 1.

The amount of addition of the filler is the same as that in example 1, but as illustrated in FIG. 9, the thermal conductivity λ of the pressure roller 20 is 1.8 W/m·K, which is higher than that in example 1. The linear expansion coefficient of the rubber layer 22 is 300 ($\times 10^{-6}$/K), which is lower than that in example 1. These two results are due to the following effects obtained by making the fiber length of the carbon fibers (CF) longer than that in example 1.

The opportunities when thermal conduction is inhibited by silicone rubber between carbon fibers (CF) decrease, and therefore, the thermal conductivity λ can be improved. The longer the length of a single carbon fiber (CF) (the higher the aspect ratio RA) is, the stronger the effect of reducing the thermal expansion can be.

Thus, in example 2, the margin of the temperature rise in a sheet non-passing portion with respect to the heat-resistant temperature can be made greater than that in example 1 (also delay in FPOT does not occur). Further, the rate of change RV in the conveying velocity is 0.57%, which is reduced as compared with that in example 1. Thus, the margin with respect to a distorted image can also be made greater than that in example 1.

Example 3 is a prescription in which the resin microballoons having a size (diameter) of 200 μm are added such that the resin microballoons are 60 volume percent of the rubber layer 22. The diameter of the resin microballoons is larger than that in example 1, and the amount of addition of the resin microballoons is also increased.

Since the void portions of the rubber layer 22 increase, the thermal conductivity λ, of the pressure roller 20 is 1.1 W/m·K, which is lower than that in example 1, as illustrated in FIG. 9. However, the thermal conductivity λ is within the range of 0.8 [W/m·K]≤λ≤2.0 [W/m·K]. Thus, a temperature rise in a sheet non-passing portion that exceeds the heat-resistant temperature and delay in FPOT do not occur.

Due to the increase in the void portions, the specific gravity of the rubber layer 22 decreases to 0.43, which is lower than that in example 1, and the linear expansion coefficient of the rubber layer 22 is 300 ($\times 10^{-6}$/K), which is lower than that in example 1. Thus, the rate of change RV in the conveying velocity is also reduced to 0.55%, which is low. This rate of change RV in the conveying velocity is a value lower than that in example 2, where the linear expansion coefficient of the rubber layer 22 is the same, namely 300 ($\times 10^{-6}$/K). This is because in example 3, where more void portions are provided than in example 2 and the rubber layer 22 has a lower specific gravity than that in example 2, a change in the diameter due to heating in the fixing nip portion N can be more reduced.

The conveying velocity of the recording material P in the fixing nip portion N is determined based on the diameter of the pressure roller 20 in the fixing nip portion N, and therefore, the rate of change RV in the conveying velocity in example 3 is reduced as compared with that in example 2. Thus, the margin with respect to a distorted image can be made even greater than that in example 2.

In example 4, the diameter of the pressure roller 20 is greater by 5 mm than that in example 1, while the prescription and the thickness of the rubber layer 22 remain the same as those in example 1. Since the diameter is greater, the rate of change RV in the conveying velocity can be reduced to 0.60%, which is lower by 0.1% than that in example 1, even though the linear expansion coefficient of the rubber layer 22 is the same as that in example 1. As described above, the margin with respect to a distorted image can also be made greater than that in example 1 without changing the rubber layer 22.

In example 5, the thickness of the rubber layer 22 is 1.5 mm, which is smaller by 1 mm than that in example 1. The other items are the same as those in example 1. Since the rubber layer 22 is thinned, the rate of change RV in the conveying velocity can be reduced to 0.46%, which is lower by 0.24% than that in example 1, even though the linear expansion coefficient of the rubber layer 22 is the same as that in example 1. As described above, the margin with respect to a distorted image can also be made greater than that in example 1 without changing the rubber layer 22.

Example 6 has a configuration in which the average length of the carbon fibers (CF) is changed to 1500 μm, and the wire diameter is changed to 7 μm, whereby the aspect ratio RA is 214.3. Further, the amount of addition of the filler is reduced as compared with that in example 1, whereby the filler is added such that the filler is 2.8 volume percent of the rubber layer 22. The other items in FIG. 8 are similar to those in example 1.

Although the amount of addition of the filler is reduced as compared with that in example 1, the thermal conductivity λ of the pressure roller 20 is 1.2 W/m·K, which is the same as that in example 1 as illustrated in FIG. 9, due to the heightening of the aspect ratio RA of the filler. The linear expansion coefficient of the rubber layer 22 is 240 ($\times 10^{-6}$/K), which is lower than that in example 1. The rate of change RV in the conveying velocity is thereby 0.53%, which is reduced as compared with that in example 1. Thus, the margin with respect to a distorted image can also be made greater than that in example 1.

Example 7 has a configuration in which the average length of the carbon fibers (CF) is changed to 25 μm, and the wire diameter is changed to 10 μm, whereby the aspect ratio RA is 2.5. The amount of addition of the filler is increased as compared with that in example 1, whereby the filler is added such that the filler is 4.2 volume percent of the rubber layer 22. The resin microballoons are also increased and added such that the resin microballoons are 54 volume percent of the rubber layer 22. The other items in FIG. 8 are similar to those in example 1.

In example 7, the thermal conductivity λ of the pressure roller 20 is 1.2 W/m·K, which is the same as that in example 1, using the filler having a relatively low aspect ratio. Example 7 is a prescription in which the resin microballoons are increased, to reduce an increase in the specific gravity and an increase in the linear expansion coefficient of the rubber layer 22 due to an increase in the amount of the filler.

The specific gravity achieves 0.51, which is lower than that in example 1, and the linear expansion coefficient of the rubber layer 22 achieves 370 ($\times 10^{-6}$/K), which is almost equivalent to that in example 1. The rate of change RV in the conveying velocity thereby becomes 0.70%, which is the same as that in example 1. Thus, the margin with respect to a distorted image is also ensured to be equivalent to that in example 1.

Example 8 is a prescription in which the same carbon fibers (CF) as those in example 7 are used, and the amount of addition of the carbon fibers (CF) is increased such that the carbon fibers (CF) are 5.7 volume percent of the rubber layer 22, and simultaneously, the amount of addition of the resin microballoons is significantly reduced, and the resin microballoons are added such that the resin microballoons are 38 volume percent of the rubber layer 22. This prescription is intended to achieve significant high thermal conduction in this manner. The linear expansion coefficient of the rubber layer 22 is 396 ($\times 10^{-6}$/K), which is increased as compared with that in example 7. The specific gravity is 0.69, which is also higher than that in example 7.

However, the thickness of the rubber layer 22 is simultaneously 1.5 mm, which is smaller by 1 mm than that in example 7, and thereby the rate of change RV in the conveying velocity is 0.65%, which is lower than that in example 7. Thus, the margin with respect to a distorted image improves as compared with that in example 7.

Comparative Example 1

Comparative example 1 has a configuration in which the carbon fibers (CF) having an average length of 18 μm, a wire diameter of 9 μm, and an aspect ratio RA of 2.0 are used. The other items in FIG. 8 are similar to those in example 1.

The filler having a low aspect ratio is used, and the amount of addition is not increased. Thus, the linear expansion coefficient of the rubber layer 22 is 405 ($\times 10^{-6}$/K), which exceeds that in example 1, and the rate of change RV in the conveying velocity is 1.00%, which exceeds that in example 1. Thus, a minor distorted image occurs. Further, the thermal conductivity λ of the pressure roller is 0.7 W/m·K, which is lower than that in example 1. Thus, a temperature rise in a sheet non-passing portion that exceeds the heat-resistant temperature may occur.

Comparative Example 2

Comparative example 2 is a prescription in which the same filler as that in example 1 is used, and the amount of addition of the filler is significantly increased as compared with that in example 1, and simultaneously, the amount of addition of the resin microballoons is significantly reduced as compared with that in example 1, and the resin microballoons are added such that the resin microballoons are 32 volume percent of the rubber layer 22. This prescription is intended to achieve significant high thermal conduction in this manner.

As illustrated in FIG. 9, the thermal conductivity λ of the pressure roller 20 is 1.4 W/m·K, which is higher than that in example 1, and the margin of the temperature rise in a sheet non-passing portion with respect to the heat-resistant temperature increases.

In this prescription, however, the resin microballoons decrease, whereby a change in the diameter due to heating in the fixing nip portion N is likely to be great. Simultaneously, the amount of the silicone rubber increases, whereby the linear expansion coefficient of the rubber layer 22 is 430 ($\times 10^{-6}$/K), which greatly exceeds that in example 1. Thus, the rate of change RV in the conveying velocity is 1.30%, which greatly exceeds that in example 1. A distorted image with low quality occurs, accordingly.

As described above, a rubber layer 22 includes a plurality of void portions 22*b*, pore passage portions 22*c* connecting the void portions 22*b*, and a filler 22*d*. Then, an aspect ratio RA of the filler 22*d* is $2.5 \leq RA \leq 215$, and the linear expansion coefficient of the rubber layer 22 is $400 \times 10^{-6}$/K or less. It is thereby possible to provide a pressure roller that reduces thermal expansion while achieving both the maintenance of a quick start property and a reduction in the temperature rise in a sheet non-passing portion.

While the present disclosure has been described above based on specific exemplary embodiments, the present disclosure is not limited to the above exemplary embodiments.

In the pressure roller 20 in examples 1 to 8, the rubber layer 22 is a single layer. Alternatively, another rubber layer (a second rubber layer) may be provided around the rubber layer 22 (a first rubber layer). As the second rubber layer, for example, a thermal insulation microballoon layer obtained by removing the carbon fibers (CF) from the rubber layer 22 in example 1 so that the voids derived from the resin microballoons do not communicate with each other, or an existing solid rubber layer can be used.

With such a two-layer structure, it is possible to adjust the balance between the speed of the temperature rise in the fixing unit 6 and the temperature rise in a sheet non-passing portion. It is desirable that the thickness of the second rubber layer should be 150 μm or more and less than 500 μm. It is more desirable that the thickness should be 200 μm or more and less than 400 μm. If the thickness is less than 150 μm, heat is transferred even in a short time scale. Thus, it is difficult to exert a sufficient quick start property. If the thickness of the second rubber layer is 500 μm or more, it takes too much time to transfer heat to the rubber layer inner layer 22, whereby heat is accumulated. Thus, it is difficult to sufficiently reduce the temperature rise in a sheet non-passing portion.

Regarding the rate of change RV in the conveying velocity, the adjustment of the parameters described in FIG. 8 can achieve the rate of change RV in the conveying velocity that prevents a distorted image from occurring, if the thickness of the second rubber layer is set to up to about 20% of the thickness of the rubber layer 22.

Although the above exemplary embodiments have been described using the fixing unit 6 in which the plate-like heater 11 is provided in the inner space of the fixing film 13, the roller according to the present disclosure may be used in a fixing unit that applies an electrical current to a fixing film and heats itself.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-172177, filed Oct. 12, 2020, which is hereby incorporated by reference herein in its entirety.

What is claimed is:

1. A roller used in a fixing device, the roller comprising:
a rubber layer including a plurality of void portions, pore passage portions connecting the void portions, and a filler,
wherein an aspect ratio RA of the filler is $2.5 \leq RA \leq 215$, and a linear expansion coefficient of the rubber layer is less than or equal to $400 \times 10^{-6}$/K.

2. The roller according to claim 1, wherein the filler is a carbon fiber or a glass fiber.

3. The roller according to claim 1, wherein an average fiber length of the filler is greater than or equal to 25 μm and less than or equal to 1500 μm.

4. The roller according to claim 1, wherein the void portions of the rubber layer are void portions derived from resin microballoons.

5. The roller according to claim 1, wherein a specific gravity of the rubber layer is less than or equal to 0.70.

6. A fixing device that fixes an image formed on a recording material to the recording material, the fixing device comprising:
a heating unit; and
a pressure roller forming a fixing nip portion with the heating unit,
wherein the pressure roller is the roller according to claim 1.

7. The fixing device according to claim 6,
wherein the heating unit includes a cylindrical film in contact with a surface of the pressure roller, and
wherein the fixing nip portion is formed between the film and the pressure roller.

8. The fixing device according to claim 7, wherein the heating unit includes a heater placed in an inner space of the film, and the fixing nip portion is formed by the heater and the pressure roller via the film.

9. The fixing device according to claim 8, wherein the heater is a plate-like heater.

10. An image forming apparatus that forms an image on a recording material, the image forming apparatus comprising:
an image bearing member;
a transfer unit configured to transfer an image formed on the image bearing member to a recording material; and
a fixing unit configured to fix the image formed on the recording material to the recording material,
wherein the fixing unit is the fixing device according to claim 6.

* * * * *